United States Patent [19]

Zelek et al.

[11] Patent Number: 4,540,042

[45] Date of Patent: Sep. 10, 1985

[54] INCLINED THERMAL TRANSFER ENHANCEMENT SYSTEM

[76] Inventors: Thomas T. Zelek, 4 Madsen Rd., West Hartford, Conn. 06110; John C. Ellsworth, 737 Arch St., New Britain, Conn. 06051

[21] Appl. No.: 316,955

[22] Filed: Oct. 30, 1981

[51] Int. Cl.[3] ..... F28D 15/00; F28F 13/00

[52] U.S. Cl. ..... 165/96; 165/86; 165/104.19

[58] Field of Search ..... 165/86, 96, 104.21, 165/104.19, 104.34, 32; 126/433, 434

[56] References Cited

U.S. PATENT DOCUMENTS

| | | | |
|---|---|---|---|
| 3,018,087 | 1/1962 | Steele | 165/104.21 |
| 3,324,667 | 6/1967 | Muller | 165/104.33 X |
| 3,472,314 | 10/1969 | Balch | 165/104.19 |
| 4,064,932 | 12/1977 | Iriarte | 165/86 X |
| 4,273,100 | 6/1981 | Cogliano | 165/96 X |

*Primary Examiner*—Albert W. Davis, Jr.
*Attorney, Agent, or Firm*—Robert S. Smith

[57] ABSTRACT

A fluid thermal storage and transfer unit which includes a fluid conduit which is substantially filled with a fluid which is substantially all of the same state. For example, the fluid may be all liquid. The loop of fluid conduit has first and second axial sections which are disposed at different elevations. Typically, a module incorporating the loop will have the first and second axial sections disposed on opposite sides.

10 Claims, 6 Drawing Figures

INCLINED THERMAL TRANSFER ENHANCEMENT SYSTEM

BACKGROUND OF THE INVENTION

The invention relates to heat transfer and storage apparatus. Applications include solar heating and cooling applications as thermal storage units which give improved heat transfer to or from the living space. Other applications include heat dissipation housings on machinery parts, engines, and the like.

Thermal storage units in solar heating and cooling applications are generally composed of large bodies of fluid, which are allowed to thermally stratify in a vertical direction. By natural convection currents, this places the warmer fluid near the top of the unit and the cooler fluid near the bottom.

In a vertical cross-sectional analysis of this type of system, one finds a much cooler fluid on one side of the thermal storage unit than on the other. The same is true of the warmer fluid. In a situation where the storage unit is used as an exterior wall of a living space, for example a Trombe wall, temperature transfer in either horizontal direction is not efficient. In heating modes, solar radiated heat is transferred to the top of the fluid area and, thus, to the internal surface toward the living space. In cooling modes, heat absorbed from the living space rises to the top of the fluid space and, thus, is distributed to the external surface.

SUMMARY OF THE INVENTION

The foregoing objects and other objects and advantages which shall become apparent from the detailed description of the preferred embodiment are attained in a heat transfer apparatus which includes an envelope having a vertical cross-section which has an elongated first axial side and an elongated second axial side, the first axial side is disposed at a higher elevation than the second axial side. A fluid is disposed in the envelope which substantially fills the envelope and all of the fluid is substantially in the same physical state. The apparatus also includes means for exchanging heat with the first axial side and means for exchanging heat with the second axial side.

Means may be disposed outside of the envelope which substantially limits movement of fluids which are outside of the envelope, between the first and second axial sides.

The apparatus may be mounted in a module. The module has first and second opposed faces, the first side disposed substantially on the first face and the second side disposed substantially on the second face. The apparatus may further include means for mounting the module for reversal of the first and second faces. The module may include at least some thermal insulation disposed to limit the flow of fluid which is outside of the envelope between the first and second axial faces. The means for mounting may be a pivotal mounting and may have a generally vertical axis. The module may be generally cylindrical. The module may be substantially a parallelpiped and the first and second opposed faces are major faces of the parallelpiped. The means for mounting may include means allowing movement to provide physical clearance to allow subsequent movement to reverse the first and second faces. The means for mounting may include at least one track engaging the means for mounting to allow pivotal motion of the module as well as motion along the track.

In other forms of the invention the apparatus may include an envelope having generally opposed top and bottom faces. The top and bottom faces are generally parallel and mounted to maintain the top and bottom surfaces in substantially oblique relationship to a horizontal plane. A fluid is disposed in the envelope which substantially fills the envelope and all of the fluid is substantially in the same physical state. First and second sides of the envelope are intermediate the top and bottom faces. The apparatus may also include means for exchanging heat with the first and second sides of the envelope.

BRIEF DESCRIPTION OF THE ACCOMPANYING DRAWING

The invention will be better understood by reference to the accompanying drawing in which.

DESCRIPTION OF THE PREFERRED EMBODIMENTS

Figure 1:
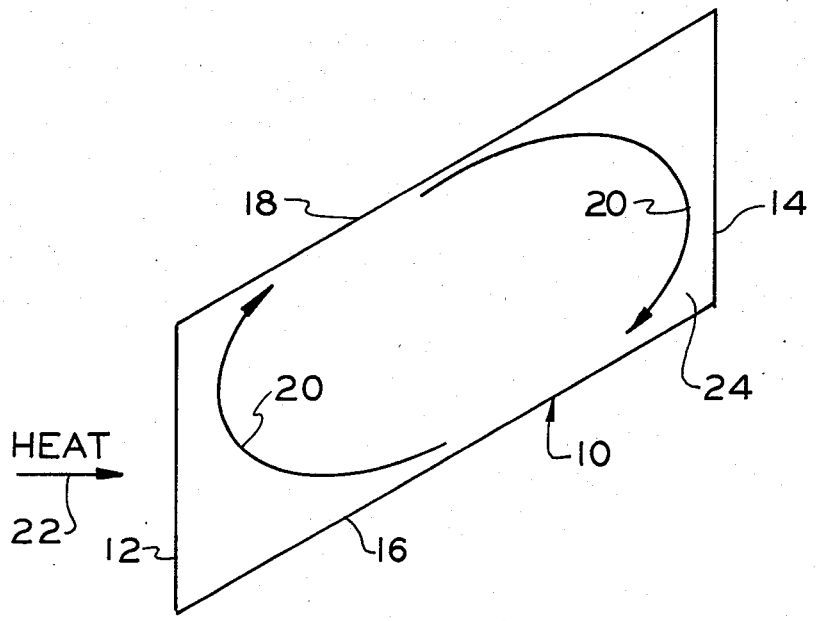
FIG. 1 is a schematic elevation view of an individual sloped element, showing a convection loop of fluid while heat is being applied.

Referring now to FIG. 1, there is shown a schematic elevational view of an individual sloped element showing a convection loop 10, which has opposed generally parallel sides 12, 14. The side 12 is elongated and lower than the elongated side 14. A bottom 16 is generally parallel to top 18 and is disposed in oblique relationship to a horizontal. Even if there is no physical divider within this structure, such as there would be with an actual piece of pipe disposed in a loop, a convection current indicated by arrows 20, 20 will be set up.

Operation of the invention depends on the thermal stratification of a fluid 24. When a heat source 22 is applied to the side 12 of the loop 10, the fluid 24 disposed adjacent to that side 12 begins to rise. Due to the sloping nature of the top 18, which the heated fluid 24 encounters, the fluid 24 movement becomes oblique, traversing the length of the compartment or loop 10 while following the upward slope. Upon reaching the highest point in the compartment 10, the heated fluid 24 collects, thus effectively transferring heat from the lower left of the loop 10 to the upper right of the loop 10, or from one side 12 of the compartment or loop 10 to the other side 14.

Figure 2:
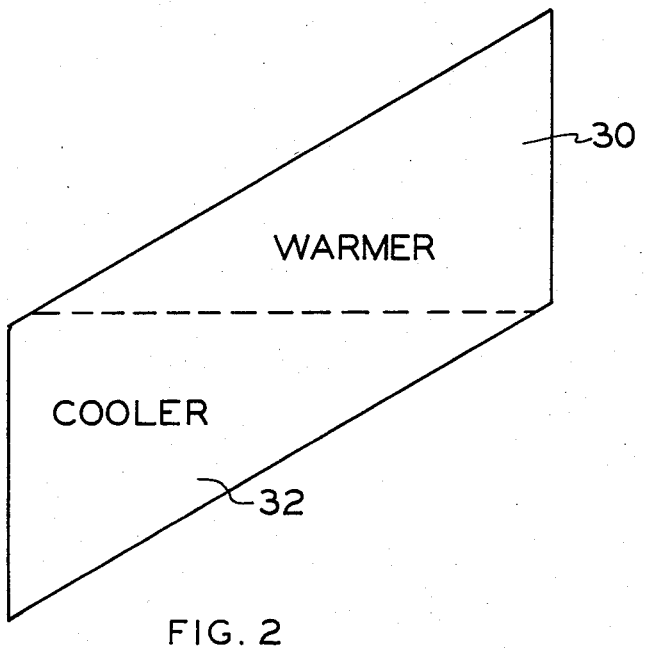
FIG. 2 is a schematic elevation view of individual sloped element, showing thermal stratification of a fluid.

FIG. 2 shows the thermal stratification principal wherein the rhombus shaped element has a triangular upper portion 30 which is generally warmer than a triangular lower portion 32.

Figure 3:
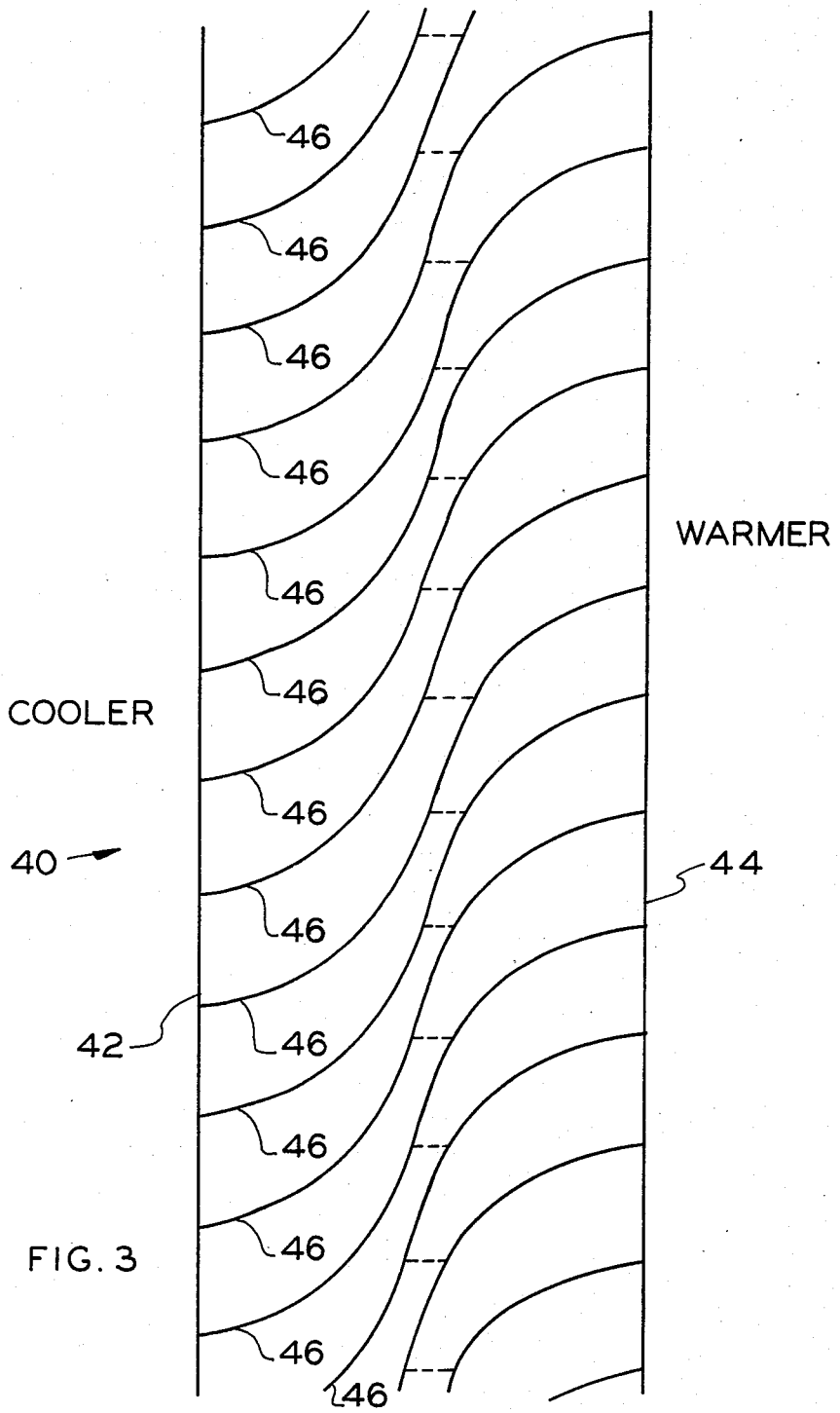
FIG. 3 is a fragmentary schematic elevational cross-section view of a preferred embodiment of a compartmentalized thermal storage and transfer unit having improved thermal stratification.

Referring now to FIG. 3, there is shown an embodiment of the invention which includes a module 40 having a side 42, which is generally cooler than opposite side 44, which is generally warmer. The module 40 has a plurality of curvilinear dividers 46 which are substantially mutually parallel. The space in between each divider 46 in this three dimensional envelope or module 40 is filled with a fluid. The apparatus in accordance with the invention does not rely on the change of state of a substance, such as from liquid to gas, and, thus, the fluid will be all liquid or all gas at all times during the operation of the cycle of the apparatus.

The dividers 46, which may be flat or straight as in the embodiments shown in FIGS. 1 and 2, force the rising heated fluid 24 toward one side, while the cooler fluid 24 sinks to the opposite side. This results in an even distribution of heat to one vertically oriented surface 44, while the opposite vertically oriented surface 42 gets an even distribution of cooler fluid 24.

Figure 4:
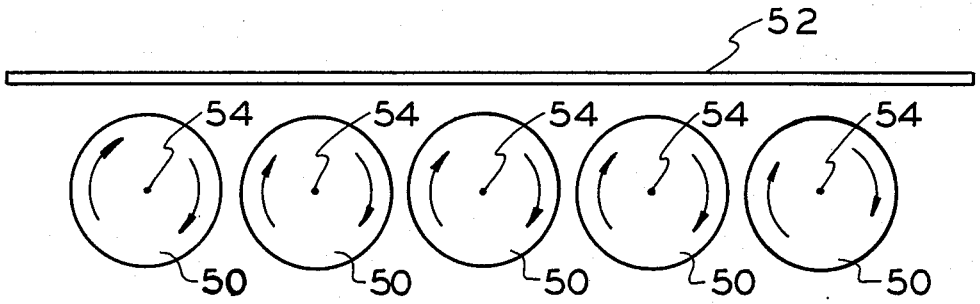
FIG. 4 is a plan view of a rotatably mounted thermal storage wall using tubular fluid containers, the rotational mechanism facilitating heating and cooling modes.
Figure 5:
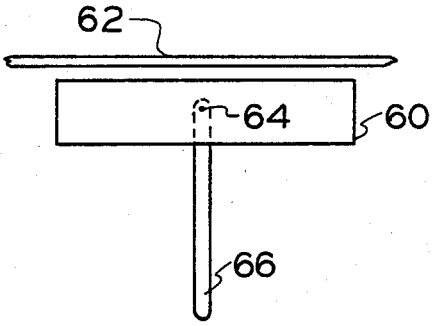
FIGS. 5 and 6 are plan views of a rotatably mounted thermal storage having box type fluid containers. A mounting mechanism includes horizontal tracks perpendicular to the exterior wall to allow movement to provide clearance for rotation.
Figure 6:
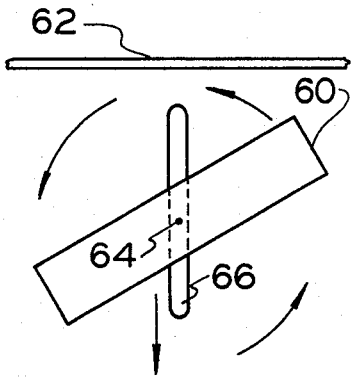

For room heating applications the compartment slope will incline towards the living space. For room cooling situations the incline will be towards the exterior of the building. If both modes are needed for seasonal changes, the heating units may be mounted to allow a 180 degree rotation on a vertical axis, as shown in the embodiments of FIGS. 4–6. A full thermal unit may consist of a multiple stacking of these compartments as shown in FIG. 3. The overall effect of this arrangement would be an increased thermal effect on the full surface area of each side.

Referring now to FIG. 4, there is shown an embodiment of the invention utilizing a plurality of generally circular modules 50, which are rotatably mounted. Each of these modules 50 has a side corresponding to the side 42 in the embodiment of FIG. 3 and side comparable to the side 44 of that same embodiment. Thus, the modules 50 may be rotated to provide heat or cooling to a room. It will be understood that the view of FIG. 5 is a plan view and that in this typical installation, glazing 52 will be disposed between the modules 50 and the outside air. The interior of a room will face the opposite side of the modules 50. Each of the modules 50 is mounted on a pivot 54 to facilitate reversal.

Referring now to FIGS. 5 and 6, there is shown another embodiment of the invention wherein a module 60 is generally rectangular. The module 60 has a warm face and a cooler face as in the embodiment of FIG. 3. These faces are the major faces of the module 60 and, as shown in FIG. 5, one such major face is disposed in facing relationship to glazing 62, which separates the module 60 from the outside air, as shown in this plan view. The module 60 is mounted on a pivot 64, which is carried on a track 66. The track 66 allows movement of the entire module 60 away from the glazing 62 so that the module 60 may be rotated to present opposite faces to the inside of a room in which the apparatus is disposed and, of course, to the outside conditions disposed, as viewed, above the glazing 62.

Many modifications and embodiments are possible within the scope and spirit of the invention.

Having thus described our invention, we claim:

1. A heat transfer module, which comprises:

an envelope having a cross-section which has generally opposed first and second surfaces, said first surface being disposed at a higher elevation than said second surface;

a fluid disposed in said envelope which substantially fills said envelope, all of said fluid being substantially in the same physical state;

means for exchanging heat with said first surface and means for exchanging heat with said second surface;

said module having first and second opposed faces, said first surface including at least a part of said first face and said second surface including at least a part of said second face; and means for mounting said module for reversal of said first and second surfaces.

2. The apparatus as described in claim 1, wherein:

said module includes at least some thermal insulation disposed to limit the flow of fluid which is outside of said envelope between said first and second surfaces.

3. The apparatus as described in claim 2, wherein:

said means for mounting is a pivotal mounting.

4. The apparatus as described in claim 3, wherein:

said pivotal mounting has a generally vertical axis.

5. The apparatus as described in claim 4, wherein:

said module is generally cylindrical.

6. The apparatus as described in claim 3, wherein:

said module is substantially a parallelpiped and said first and second opposed faces are major faces of said parallelpiped.

7. The apparatus as described in claim 6, wherein:

said means for mounting includes means allowing movement which provides physical clearance to allow subsequent movement to reverse said first and second faces.

8. The apparatus as described in claim 3, wherein:

said means for mounting includes at least one track engaging said means for mounting to allow pivotal motion of said module as well as motion along said track.

9. A heat transfer module, which comprises:

an envelope having generally opposed top and bottom faces, said top and bottom faces being generally parallel and mounted to maintain said top and bottom surfaces in substantially oblique relationship to a horizontal plane;

a fluid disposed in said envelope which substantially fills said envelope, all of said fluid being substantially in the same physical state;

first and second sides of said envelope intermediate said top and bottom faces;

means for exchanging heat with said first and second sides of said envelope intermediate said top and bottom faces;

said module having first and second opposed faces, said first side being disposed substantially on said first face and said second side being disposed substantially on said second face; and means for mounting said module for reversal of said first and second sides.

10. The apparatus as described in claim 9, wherein:

said module includes at least some thermal insulation disposed to limit the flow of fluid which is outside of said envelope between said first and second sides.

* * * * *